US011098638B2

(12) United States Patent
Pocha Siva Sankara et al.

(10) Patent No.: US 11,098,638 B2
(45) Date of Patent: Aug. 24, 2021

(54) ENGINE JACKET COOLING SYSTEM FOR LOCOMOTIVE

(71) Applicant: Progress Rail Locomotive Inc., LaGrange, IL (US)

(72) Inventors: Reddy Pocha Siva Sankara, Naperville, IL (US); Mathias Klemp, Kokomo, IN (US); Vijaya Kumar, Naperville, IL (US); Michael B. Goetzke, Orland Park, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 0 days.

(21) Appl. No.: 16/206,682

(22) Filed: Nov. 30, 2018

(65) Prior Publication Data

US 2020/0173342 A1 Jun. 4, 2020

(51) Int. Cl.

| | |
|---|---|
| ***F01P 7/16*** | (2006.01) |
| ***F01P 11/16*** | (2006.01) |
| ***F01P 3/02*** | (2006.01) |
| ***F01P 11/18*** | (2006.01) |
| ***F01P 7/14*** | (2006.01) |

(52) U.S. Cl.

CPC ..... *F01P 7/161* (2013.01); *F01P 3/02* (2013.01); *F01P 11/16* (2013.01); *F01P 11/18* (2013.01); *F01P 2003/027* (2013.01); *F01P 2007/146* (2013.01)

(58) Field of Classification Search

CPC .. F01P 7/161; F01P 11/18; F01P 11/16; F01P 3/02; F01P 2007/146; F01P 2003/027

See application file for complete search history.

(56) References Cited

U.S. PATENT DOCUMENTS

| | | | | |
|---|---|---|---|---|
| 6,712,028 | B1 * | 3/2004 | Robbins | F01P 7/161 123/41.08 |
| 9,518,503 | B2 | 12/2016 | Tsuchiya et al. | |
| 2004/0041035 | A1 * | 3/2004 | Takei | F01P 7/167 236/34.5 |
| 2009/0205590 | A1 * | 8/2009 | Vetrovec | F28F 1/40 123/41.14 |

(Continued)

FOREIGN PATENT DOCUMENTS

| | | | |
|---|---|---|---|
| CN | 205117479 | U | 3/2016 |
| CN | 107461255 | A | 12/2017 |
| JP | 2007170352 | A | 5/2005 |

*Primary Examiner* — Joseph J Dallo
*Assistant Examiner* — Kurt Philip Liethen
(74) *Attorney, Agent, or Firm* — von Briesen & Roper, s.c.

(57) ABSTRACT

A jacket cooling system for an engine of a locomotive is disclosed. The jacket cooling system may comprise a jacket coolant pump driven by a crankshaft of the engine. The jacket cooling system may further comprise a coolant jacket associated with one or more components of the engine, and a delivery conduit in fluid communication with the outlet of the jacket coolant pump and configured to deliver a coolant from the jacket coolant pump to the coolant jacket. The jacket cooling system may further comprise a bypass circuit configured to divert the coolant away from the delivery conduit and the engine, and an electronically-controlled bypass valve in the bypass circuit. The bypass valve may allow at least some of the coolant to flow through the bypass circuit when a valve position of the bypass valve is at least partially open.

20 Claims, 7 Drawing Sheets

(56) References Cited

U.S. PATENT DOCUMENTS

| | | | | |
|---|---|---|---|---|
| 2016/0001799 | A1* | 1/2016 | Cook | B61C 17/12 105/35 |
| 2016/0169141 | A1* | 6/2016 | Flynn | F02D 41/1498 701/102 |
| 2016/0186648 | A1* | 6/2016 | Rollinger | B60W 10/00 123/41.15 |
| 2018/0086175 | A1* | 3/2018 | Bidner | F02B 29/0443 |
| 2018/0252146 | A1* | 9/2018 | Nagai | F01P 3/02 |
| 2019/0234291 | A1* | 8/2019 | Cunningham | F01P 1/06 |

* cited by examiner

ENGINE JACKET COOLING SYSTEM FOR LOCOMOTIVE

TECHNICAL FIELD

The present disclosure generally relates to engine jacket cooling systems for locomotives and, more specifically, engine jacket cooling systems for locomotives with coolant flow to the engine varying depending on operating conditions.

BACKGROUND

A locomotive is a vehicle of a train that provides the motive power to haul the train. The locomotive may include an internal combustion engine (e.g., a diesel engine) that combusts fuel in the presence of air to provide power that propels the locomotive. The energy output of the internal combustion engine may drive the rotation of a crankshaft that directly or indirectly drives various other components and auxiliary devices of the locomotive. Under rated power operating conditions of the engine, the engine may be operating at the maximum power and speeds at which the engine is designed to handle. Under idle power operating conditions or low power operating conditions, the engine may be operating at minimal or substantially reduced power and speeds.

The internal combustion engine may include a cylinder having walls that define a combustion chamber in which the combustion reactions take place. A coolant jacket associated with the cylinder may permit a coolant to flow around the cylinder walls for absorbing heat from the combustion chamber as well as other components of the engine that may be susceptible to high temperatures during operation. The coolant may be pumped into the coolant jacket from a jacket coolant pump that is driven by the crankshaft, and the heated coolant exiting the coolant jacket may be cooled by a radiator before returning to the jacket coolant pump.

Current jacket coolant pumps are designed to meet the rated power operating conditions of the engine. As such, when the locomotive is operating under idle or lower power conditions, the jacket coolant pump may flow more coolant than needed to the engine. As the jacket coolant pump is driven by the engine crankshaft, the flow rate of coolant to the engine may decrease in proportion to the drop in engine speed on going from rated power to idle or low power conditions. However, the engine speed and the flow rate of coolant to the engine may not decrease in proportion to the drop in power on transitioning from rated power conditions to idle or low power conditions. Accordingly, more coolant flows through the coolant jacket than is needed under or lower power conditions, and more heat may be extracted from the engine by the coolant than desired. This over-dissipation or waste of heat through the jacket coolant when the engine is operating at the lower end of its speed and power range reduces the amount of energy available to do useful work. Consequently, fuel economy and even engine emissions may be negatively impacted under idle or lower power operating conditions due to excess coolant being pumped to the engine coolant jacket. This effect may counteract current manufacturing aims to maximize fuel economy and reduce locomotive engine emissions.

Efforts have been made to reduce cooling water flow to engine coolant jackets during engine warm up to reduce engine warm up time. For example, Chinese patent application publication number CN205117479 discloses a ball valve in a connecting pipe between a water pump and an engine water jacket, whereby the ball valve is closed by the electronic control unit (ECU) to avoid heat dissipation from the engine during engine warm up.

However, there is still a need for improved strategies for controlling coolant flow in locomotive jacket cooling systems, particularly under idle or low power operating conditions.

SUMMARY

In accordance with one aspect of the present disclosure, a jacket cooling system for an engine of a locomotive is disclosed. The jacket cooling system may comprise a jacket coolant pump driven by a crankshaft of the engine and having an inlet and an outlet. The jacket cooling system may further comprise a coolant jacket associated with one or more components of the engine, a delivery conduit in fluid communication with the outlet of the jacket coolant pump and configured to deliver a coolant from the jacket coolant pump to the coolant jacket, and a bypass circuit configured to divert the coolant away from the delivery conduit and the engine and to route the diverted coolant to the inlet of the jacket coolant pump. The jacket cooling system may further comprise an electronically-controlled bypass valve in the bypass circuit. The bypass valve may allow at least some of the coolant to flow through the bypass circuit when a valve position of the bypass valve is at least partially open.

In accordance with another aspect of the present disclosure, a locomotive is disclosed. The locomotive may comprise an internal combustion engine that includes a cylinder defining a combustion chamber, a crankshaft driven for rotation by the internal combustion engine, a coolant jacket associated with the cylinder, and a jacket coolant pump driven by the crankshaft and having an inlet and an outlet. In addition, the locomotive may further comprise a delivery conduit in fluid communication with the outlet of the jacket coolant pump and configured to carry coolant from the jacket coolant pump to the coolant jacket, and a bypass circuit configured to divert the coolant away from the delivery conduit and the engine, and to route the diverted coolant to the inlet of the jacket coolant pump. Furthermore, the locomotive may further comprise an electronic control module (ECM) associated with the engine, and a bypass valve in the bypass circuit and controlled by the ECM. The bypass valve may be configured to allow at least some of the coolant to flow through the bypass circuit when a valve position of the bypass valve is at least partially open. The locomotive may further comprise an actuator associated with the bypass valve and in electronic communication with the ECM. The actuator may be configured to actuate shifting of the valve position of the bypass valve according to commands from the ECM.

In accordance with another aspect of the present disclosure, a method for regulating a flow of coolant through a jacket cooling system associated with an engine of a locomotive is disclosed. The jacket cooling system may include a jacket coolant pump, a delivery conduit configured to deliver the coolant from the jacket coolant pump to a coolant jacket associated with the engine, and a bypass valve allowing at least some of the coolant to be diverted away from the delivery conduit and into a bypass circuit when at least partially open. The method may comprise receiving a signal indicating one or more operation conditions of the engine, determining a desired valve position of the bypass valve based on the one or more signals indicating the one or more operation conditions of the locomotive, determining if the desired valve position deviates from a current valve position of the bypass valve, and commanding an actuator associated with the bypass valve to adjust the current position to the desired valve position if the current valve position deviates from the desired valve position.

These and other aspects and features of the present disclosure will be more readily understood when read in conjunction with the accompanying drawings.

DETAILED DESCRIPTION

Figure 1:
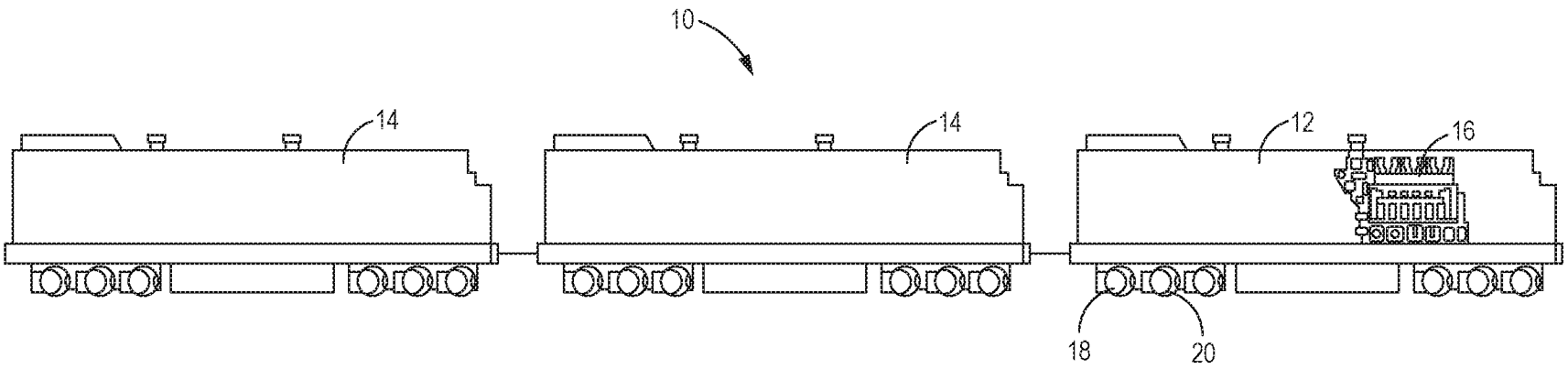
FIG. 1 is a side view of a train including a locomotive, constructed in accordance with the present disclosure.

Referring now to the drawings, and with specific reference to FIG. 1, a train 10 having a locomotive 12 is shown. The train 10 may consist of interconnected cars 14 powered for movement by the locomotive 12. The locomotive 12 may include one or more internal combustion engines 16 that combust diesel fuel in the presence of air to provide power that propels the locomotive 12 and the train 10 as a whole. The power provided by the engine 16 may be directed to traction motors 18 that propel the train by driving the rotation of wheels 20. The internal combustion engine 16 may be a medium speed diesel engine configured to operate in a range of about 200 rpm to about 1100 rpm, although the speed range of the engine 16 may certainly deviate from this depending on the design of the locomotive 12. Under rated or higher power operating conditions of the engine 16, the engine speed may be between about 900 rpm to about 1100 rpm depending on the design of the engine. Under idle or lower power operating conditions, the engine speed may be between about 200 rpm to about 350 rpm depending on the operation conditions and the design of the engine. However, in some circumstances, the engine speeds under rated power operating conditions or under idle or lower power operating conditions may vary from these ranges as well. Furthermore, in alternative arrangements, the engine 16 may be a low or a high speed engine, and/or it may combust other types of fuels including mixtures of different fuels.

Figure 2:
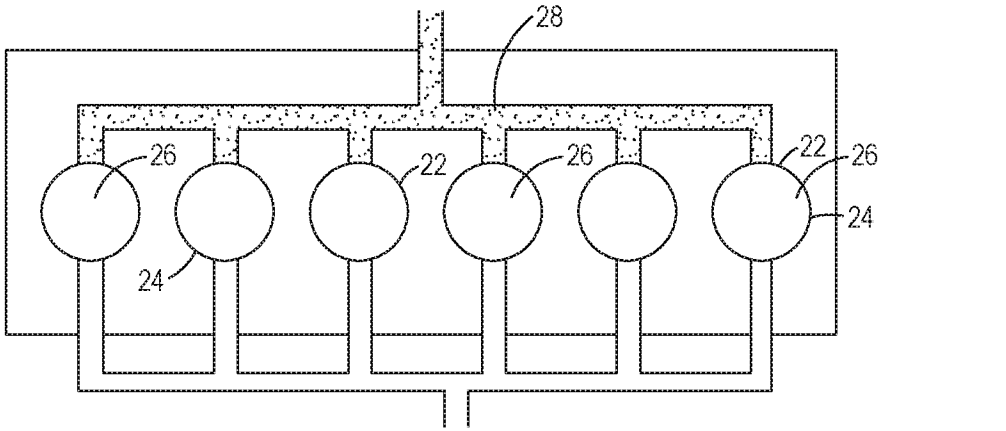
FIG. 2 is a schematic representation of an engine of the locomotive, constructed in accordance with the present disclosure.

As shown in FIG. 2, the internal combustion engine 16 may include a plurality of cylinders 22 each having walls 24 defining a combustion chamber 26 where the combustion reactions take place. An intake manifold 28 may direct compressed intake air to the combustion chambers 26, and an exhaust manifold 30 may carry exhaust gases produced by the combustion process to the atmosphere. Although FIG. 2 shows the engine 16 with six cylinders 22, it will be understood that this arrangement is merely exemplary, and that the actual number of cylinders 22 may vary and that the cylinders 22 may be arranged inline or in a V-type configuration.

Figure 3:
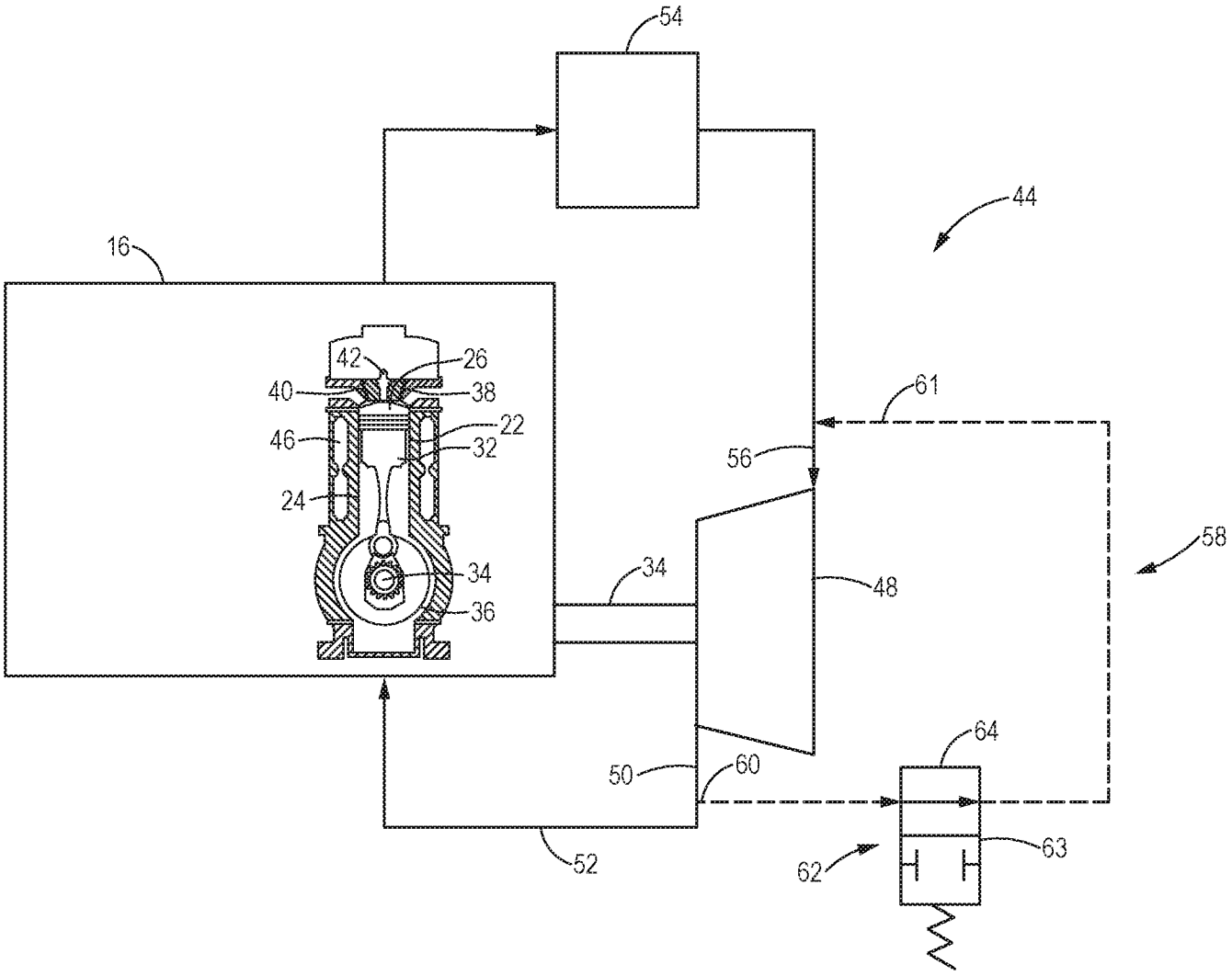
FIG. 3 is a schematic representation of a jacket cooling system associated with the engine having a bypass circuit with a bypass valve in an open position, constructed in accordance with the present disclosure.

The configuration one of the cylinders 22 of the engine 16 is shown in more detail in FIG. 3. The cylinder 22 may house a piston 32 that reciprocates up and down during the combustion cycles to drive the rotation of a crankshaft 34 housed in a crankcase 36. An inlet valve 38 may control the inflow of the intake air into the combustion chamber 26 from the intake manifold 28, and an outlet valve 40 may control the outflow of exhaust gas out of the combustion chamber 26 to the exhaust manifold 30. Furthermore, a fuel injector 42 may inject fuel into the combustion chamber 26 for combustion.

Referring still to FIG. 3, the locomotive may have a jacket cooling system 44 for cooling one or more components of the engine 16. The jacket cooling system 44 may flow a coolant, such as water, through a coolant jacket 46 associated with one or more components of the engine 16, such as the cylinder 22. For instance, the coolant jacket 46 may permit the coolant to be circulated around the cylinder walls 24 to absorb heat from the combustion chamber 26. The jacket cooling system 44 may further include a jacket coolant pump 48 for pumping the coolant to the coolant jacket 46. The jacket coolant pump 48 may be driven by the crankshaft 34 by a fixed gear ratio. An outlet 50 of the pump 48 may be in fluid communication with one or more delivery conduits 52 that deliver the coolant from the jacket coolant pump 48 to the coolant jacket 46. While passing through the coolant jacket 46, the coolant may extract heat from the combustion chamber 26 and other components of the engine 16. The heated coolant exiting the coolant jacket 46 may subsequently undergo heat exchange and re-cooling at a downstream jacket coolant radiator 54 before being directed back to an inlet 56 of the jacket coolant pump 48.

The jacket cooling system 44 may further include a bypass circuit 58 configured to divert coolant away from the delivery conduit 52 (and the engine 16) under certain engine operating conditions, as explained more specifically below. As shown in FIG. 3, the bypass circuit 58 may direct the diverted coolant away from the delivery conduit 52 for re-introduction into the inlet 56 of the jacket coolant pump 48. As such, an inlet 60 of the bypass circuit 58 may be connected to and in fluid communication with the delivery conduit 52 and/or the outlet 50 of the jacket coolant pump 48, and an outlet 61 of the bypass circuit may be connected to and in fluid communication with the inlet 56 of the jacket coolant pump 48. Within the bypass circuit 58 may be a bypass valve 62 to regulate the flow of the coolant through the bypass circuit 58. When the bypass valve 62 is in an at least partially open position, at least a fraction of the coolant may naturally flow in the direction of the bypass circuit 58 due to the higher flow resistance of the engine 16 than in the delivery conduit 52 leading to the engine 16.

Figure 4:
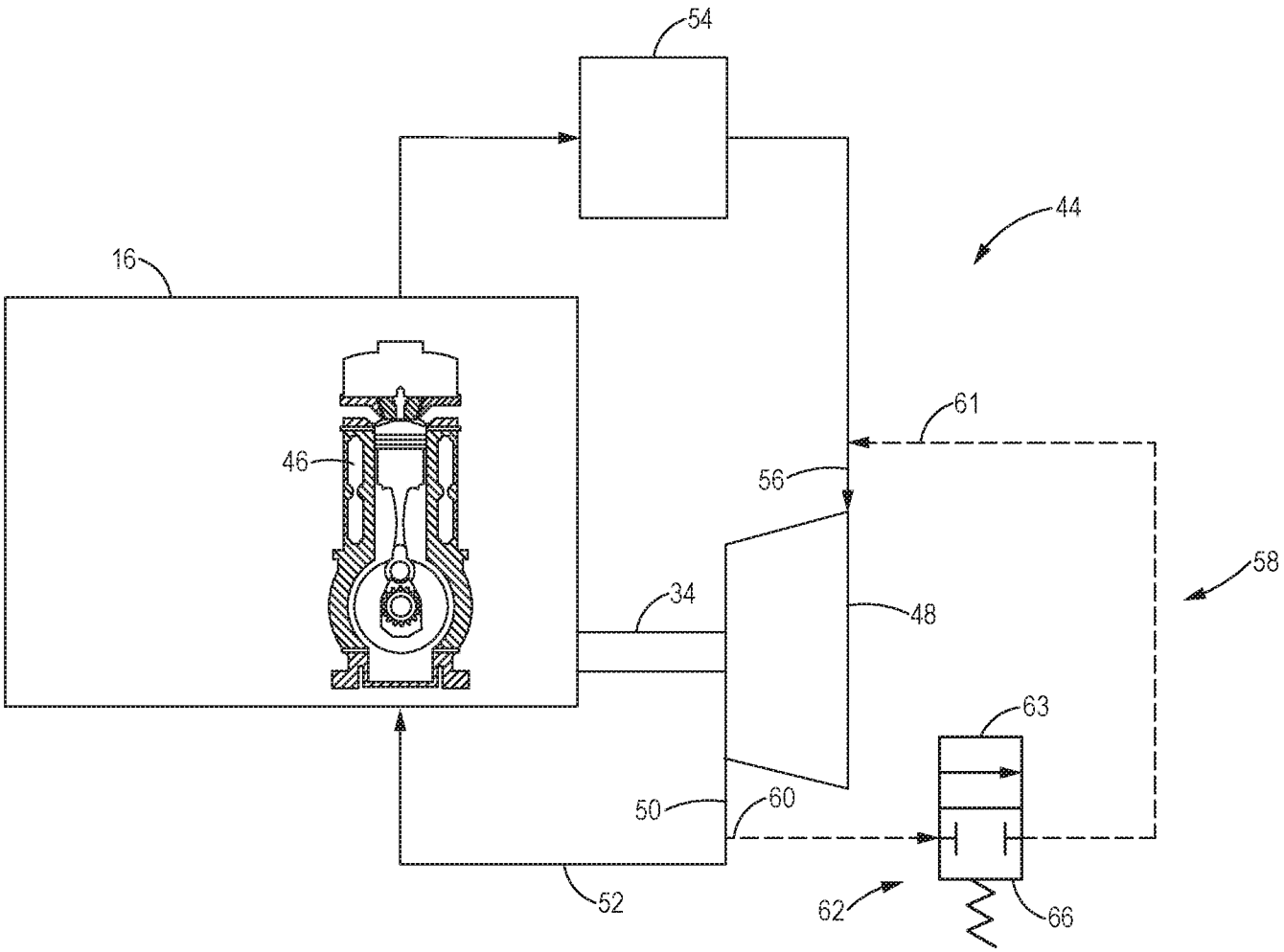
FIG. 4 is a schematic representation similar to FIG. 3 but with the bypass valve being in a closed position, constructed in accordance with the present disclosure.

In one embodiment, the bypass valve 62 may be a mechanical spring-loaded valve 63 having an open position 64 (FIG. 3) and a closed position 66 (FIG. 4). The spring-loaded valve 63 may be configured such that the valve 63 is in the open position 64 when a fluid pressure in the delivery conduit 52 (or at the outlet 50 of the pump 48) is lower than the pressure setting of the valve 63. That is, the pressure setting of the valve 63 may be set such that the valve 63 is in the open position 64 when the jacket coolant pump 48 (and the engine 16) are operating at speeds associated with idle or lower power operating conditions. More specifically, when the engine 16 is operating at idle or lower power operating conditions, the valve 63 may be open to divert at least some of the coolant away from the delivery conduit 52 and the engine 16 through the bypass circuit 58. The open position 64 of the valve 63 thus avoids excess heat from being dissipated into the coolant under idle or lower power operating conditions, and thereby improves engine fuel economy and reduces engine emissions.

Under rated power operating conditions of the engine 16, the substantially higher fluid pressure in the delivery conduit 52 (or at the outlet 50 of the pump 48) may cause the valve 63 to shift to the closed position 66 due to spring compression (see FIG. 4). Specifically, under rated power operating conditions, the engine crankshaft 34 will rotate at higher speeds, thereby increasing the speed of the jacket coolant pump 48 and the flow rate (and the fluid pressure) of the coolant at the outlet 50 and in the delivery conduit 52. With the fluid pressure in the delivery conduit 52 (or at the outlet 50) being above the pressure setting of the valve 63 under rated power operating conditions, the valve 63 may shift to the closed position 66 so that the coolant flows to the engine 16 and through the coolant jacket 46. The closing of the valve 63 advantageously directs more coolant to the coolant jacket 46, allowing more heat to be absorbed into the coolant under rated power operating conditions. Accordingly, the bypass circuit 58 and the bypass valve 62 permit the jacket cooling system 44 to increase the flow rate of coolant to the engine 16 when more heat is produced in the engine 16 under rated power operating conditions, and to decrease the flow rate of coolant to the engine 16 when substantially less heat is produced in the engine 16 under idle or lower power operating conditions.

Figure 5:
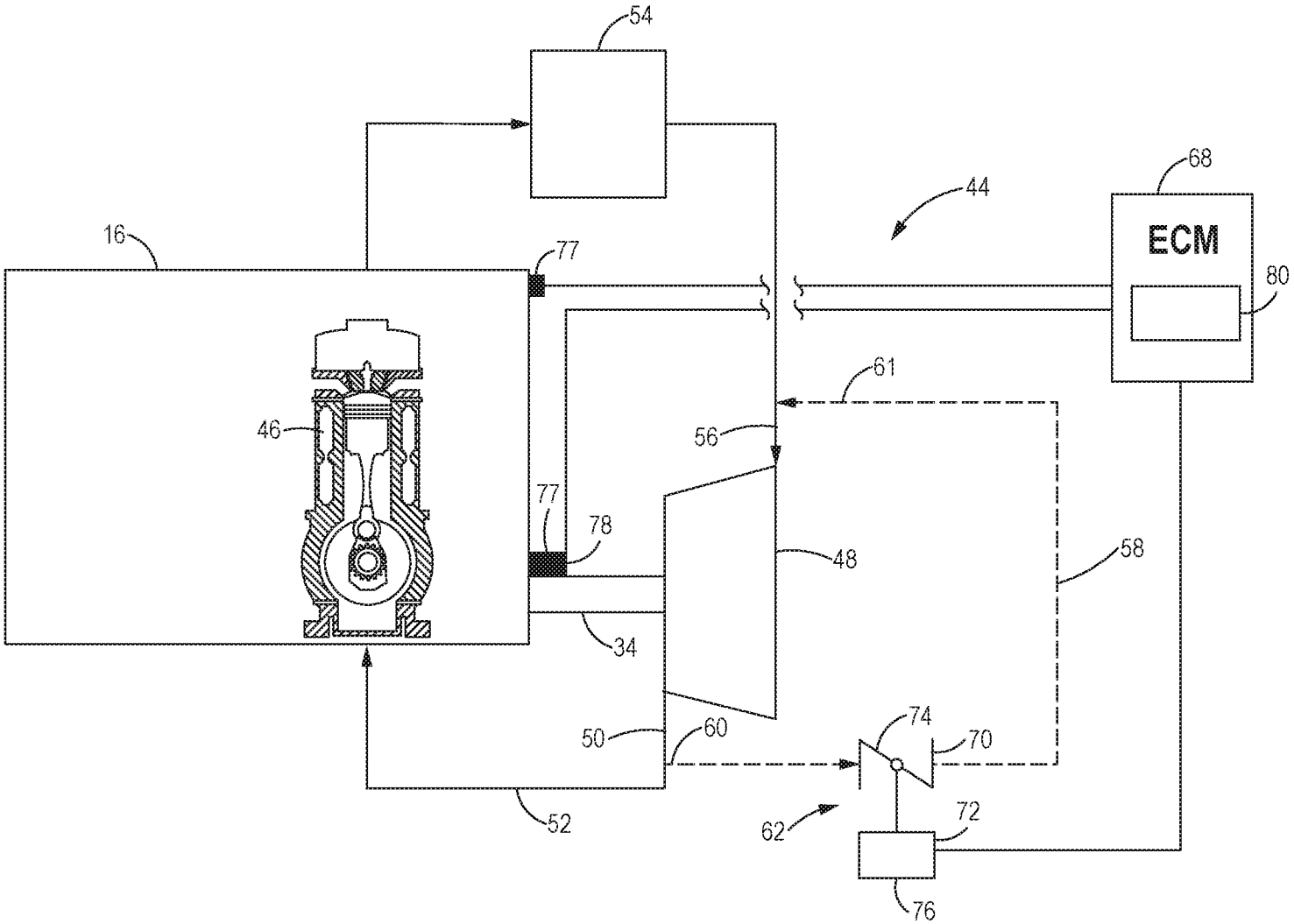
FIG. 5 is a schematic representation similar to FIGS. 3 and 4, but with the bypass valve being electronically controlled by an engine electronic control module (ECM), constructed in accordance with the present disclosure.
Figure 6:
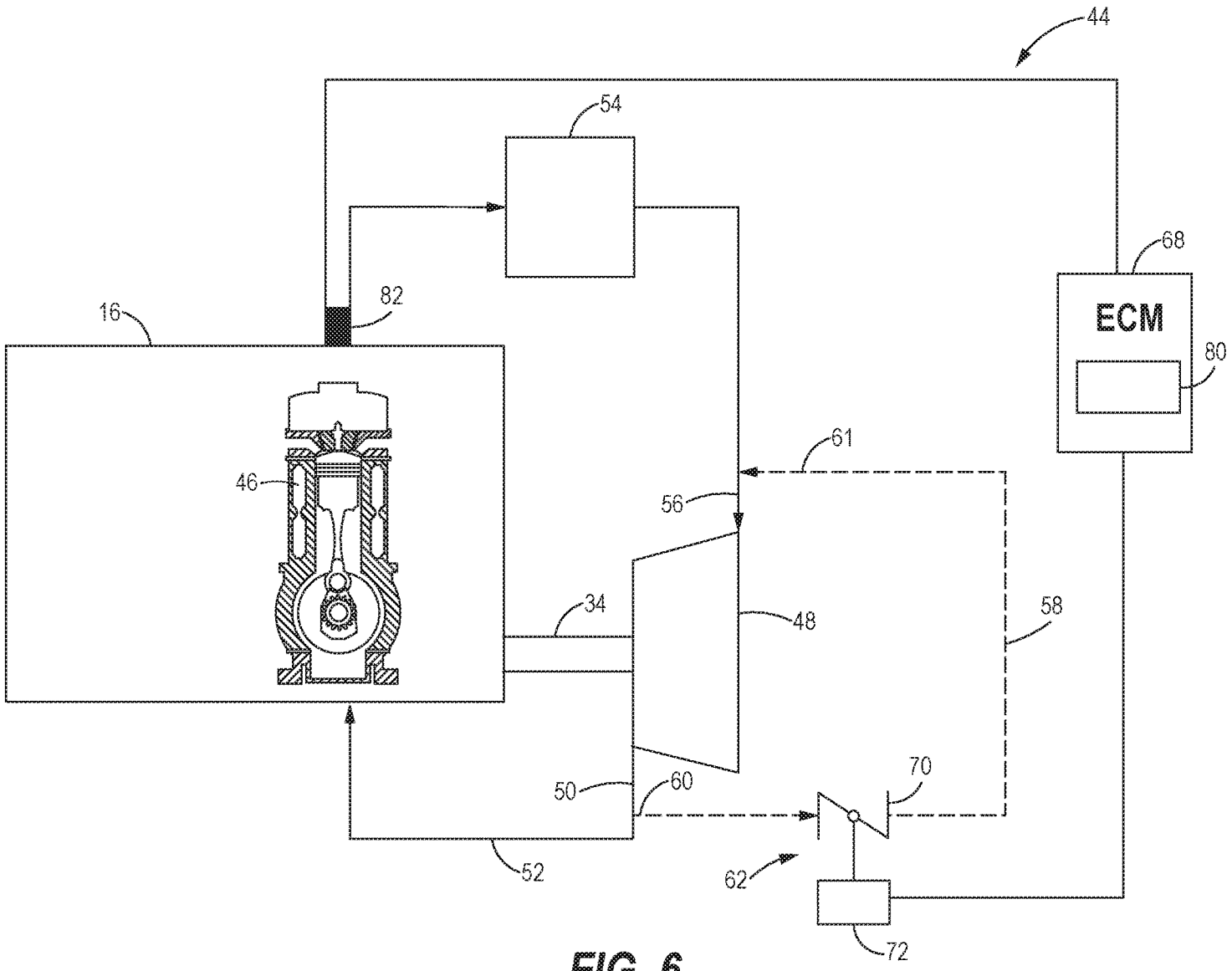
FIG. 6 is a schematic representation similar to FIG. 5, but with the electronically-controlled bypass valve being controlled based on feedback from a jacket coolant temperature sensor, constructed in accordance with the present disclosure.

In an alternative embodiment, the bypass valve 62 may be electronically controlled by an electronic control module (ECM) 68 associated with the engine 16, as shown in FIGS. 5-6. In this arrangement, the bypass valve 62 may be an electronically-controlled bypass valve 70. An actuator 72 may be associated with the bypass valve 70 and may be in electronic communication with the ECM 68, such that the actuator 72 may actuate the shifting of the valve position of the bypass valve 70 based on electronic commands received from the ECM 68. According to the commands from the ECM 68, the valve position of the bypass valve 70 may vary between a fully open position, a fully closed position, and a myriad of intermediate partially open/partially closed positions to finely tune the distribution of coolant to the delivery conduit 52 and the bypass circuit 58, as explained more specifically below. As a non-limiting example, the bypass valve 70 may be a butterfly valve 74 configured to rotate through various partially open/partially closed valve positions as will be understood by those skilled in the art. In other arrangements, the bypass valve 70 may be other types of valves compatible with electronic control such as, but not limited to, a solenoid valve, a ball valve, a needle valve, or a gate valve. The actuator 72 associated with the bypass valve 70 may be an electronic actuator, a hydraulic actuator, a pneumatic actuator, or other suitable actuators capable of responding to commands from the ECM 68. As a non-limiting example, the actuator 72 may be an electric motor 76 configured to convert electrical signals from the ECM 68 into rotational energy that rotates the butterfly valve 74 to the commanded valve position.

Referring to FIG. 5, the ECM 68 may control the valve position based on one or more operation conditions such as, but not limited to, the speed of the engine, the engine load, traveling altitude, ambient temperatures, and/or special operation conditions. Specifically, the ECM 68 may be in communication with one or more operation condition sensors 77 such as an engine speed sensor 78 configured to monitor the speed of the engine 16. The engine speed sensor 78 may be associated with the crankshaft 34 to monitor the rotation rate of the crankshaft 34, and may transmit signals to the ECM 68 indicative of the engine speed. The ECM 68 may also be in communication with other types of operation conditions sensors 77 configured to monitor other operation conditions such as, but not limited to, engine load, ambient temperature, traveling altitude, and/or special operating conditions. Based on signals received from the sensors 77, the ECM 68 may determine a desired valve position for the bypass valve 70 using one or more valve control maps 80 stored a memory of the ECM 68 or otherwise electronically (or wirelessly) accessible to the ECM 68. The valve control map(s) 80 may correlate the one or more operation conditions with desired valve positions. For example, each engine speed of the engine 16 may have a corresponding desired valve position in the valve control map 80. Upon determination of the desired valve position from the valve control map(s) 80, the ECM 68 may transmit a command to the actuator 72 to adjust the valve position to the desired valve position. In general, the valve control maps 80 may correlate higher engine speeds, higher engine loads, and/or higher ambient temperatures with more closed valve positions so that more coolant flows to the engine 16 via the delivery conduit 52. The valve control maps 80 may correlate lower engine speeds, lower engine loads, and/or lower ambient temperatures with more open valve positions so that more coolant bypasses the engine 16 through the bypass circuit 58. Thus, the jacket cooling system disclosed herein allows the flow rate of coolant to the engine 16 to be increased under rated or higher power operating conditions (which generate more heat in the engine 16), and decreased under idle or lower power operating conditions. This advantageously avoids the dissipation of excess heat into the coolant when less heat is produced by the engine under idle or lower power operating conditions.

Alternatively, the ECM 68 may be configured to control the valve position of the bypass valve 70 based on the temperature of the coolant (see FIG. 6). In this arrangement, the ECM 68 may be in communication with a temperature sensor 82 configured to monitor a jacket coolant temperature of the coolant exiting the coolant jacket 46. For example, the temperature sensor 82 may be located near an outlet of the coolant jacket 46, or another position suitable for monitoring the temperature of the coolant as the coolant exits the coolant jacket 46. The ECM 68 may include a proportional integral (PI) controller 84 that receives signals from the temperature sensor 82 indicative of the jacket coolant temperature, and determines a temperature deviation between the jacket coolant temperature and a desired jacket coolant temperature. As used herein, the jacket coolant temperature may be the temperature of the coolant when the coolant exits the coolant jacket 46 as detected by the temperature sensor 82. In addition, the desired jacket coolant temperature may be the desired temperature of the coolant as the coolant exits the coolant jacket 46. The desired jacket coolant temperature may vary depending on the design of the locomotive 12 as well as the operating conditions of the engine 16.

Upon determining the temperature deviation between the jacket coolant temperature and the desired jacket coolant temperature, the PI controller 84 may transmit a command to the actuator 72 to open or close the bypass valve 70 by a magnitude that is proportional to the temperature deviation. If the jacket coolant temperature is below the desired jacket coolant temperature indicating colder engine operating conditions (such as due to engine start up, low ambient temperatures, and/or idle or low power operating conditions), the PI controller 84 may command the actuator 72 to open the bypass valve 70 to direct coolant through the bypass circuit 58 and prevent heat loss from the engine 16 into the coolant. Alternatively, if the jacket coolant temperature is above the desired jacket coolant temperature indicating hotter operating conditions (such as during rated or higher power operating conditions), the PI controller 84 may command the actuator 72 to close the bypass valve 70 so that more coolant flows to the engine 16 through the delivery conduit 52 for heat absorption. In either scenario, the PI controller 84 may command the actuator 72 to open or close the bypass valve 70 by a degree or magnitude that is proportional to the temperature deviation until the deviation between the jacket coolant temperature and the desired jacket coolant temperature is eliminated or minimized.

In other arrangements, the ECM 68 may be configured to control the valve position of the bypass valve 70 based on a combination of various conditions such as the engine speed, engine load, ambient temperature, traveling altitude, the coolant temperature, and/or other operation conditions using either or both of map-based control (FIG. 5) or the PI controller 84 (FIG. 6). Variations such as these are also encompassed by the scope of the present disclosure.

INDUSTRIAL APPLICABILITY

In general, the teachings of the present disclosure may find applicability in many industries including, but not limited to, locomotive industries. More specifically, the teachings of the present disclosure may be applicable to locomotive engine designs, or to other industries relying engine jacket cooling systems.

Figure 7:
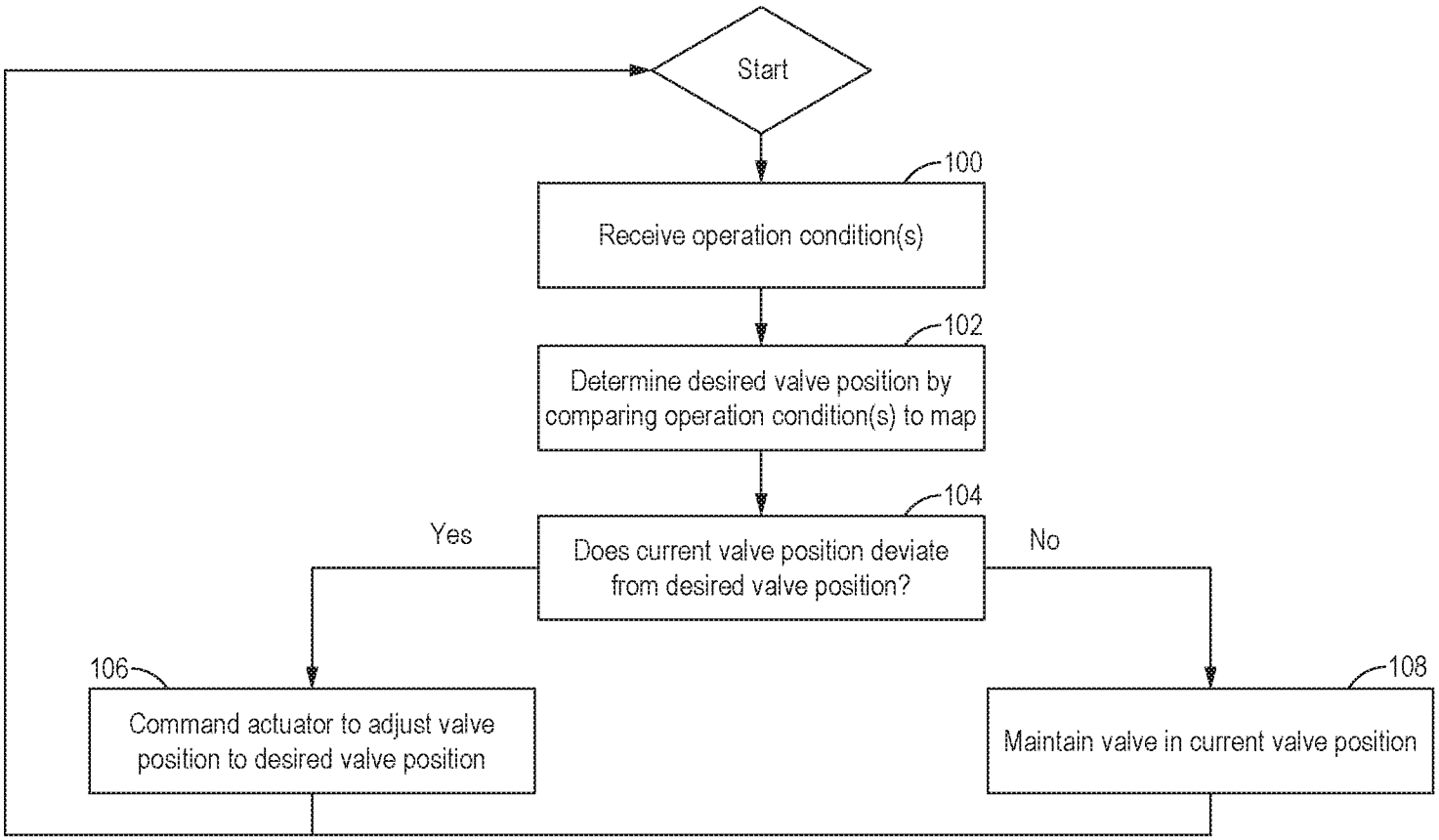
FIG. 7 is a flowchart of a series of steps that may be involved in regulating coolant flow through the jacket cooling system as implemented by the engine ECM, in accordance with a method of the present disclosure.

FIG. 7 shows a series of steps that may be involved in regulating the electronically-controlled bypass valve 70 as implemented by the ECM 68 in accordance with the jacket cooling system 44 of FIG. 5. Specifically, the method of FIG. 7 shows a series of steps that may be involved in regulating the valve position of the bypass valve 70 as dictated by the valve control map(s) 80 of the ECM 68 as the operation conditions of the locomotive vary. At a first block 100, the ECM 68 may receive signals indicative of the operation conditions (e.g., engine speed, engine load, altitude, ambient temperature, special operation conditions, etc.) from the one or more sensors 77. The ECM 68 may then determine the desired valve position by comparing the one or more operation conditions to the valve control map(s) 80 (block 102). For example, the valve control map 80 may correlate higher engine speeds and higher engine loads (e.g., rated power operating conditions) with more closed valve positions so that more coolant flows to the engine 16 for cooling, and lower engine speeds and lower engine loads (e.g., idle power operating conditions) with more open valve positions so that more coolant is directed through the bypass circuit 58 to avoid heat excess dissipation from the engine into the coolant. At a block 104, the ECM 68 may determine if the current valve position of the bypass valve 70 deviates from the desired valve position. If the current valve position does deviate from the desired valve position, then the ECM 68 may transmit a command to the actuator 72 to adjust the valve position to the desired valve position (block 106). If the current valve position does not deviate from the desired valve position, then the current valve position may be maintained (block 108). The method of FIG. 7 may be repeated continually during the operation of the locomotive 12 to appropriately apportion coolant to the engine 16 and the bypass circuits 58 as the operation conditions vary.

Figure 8:
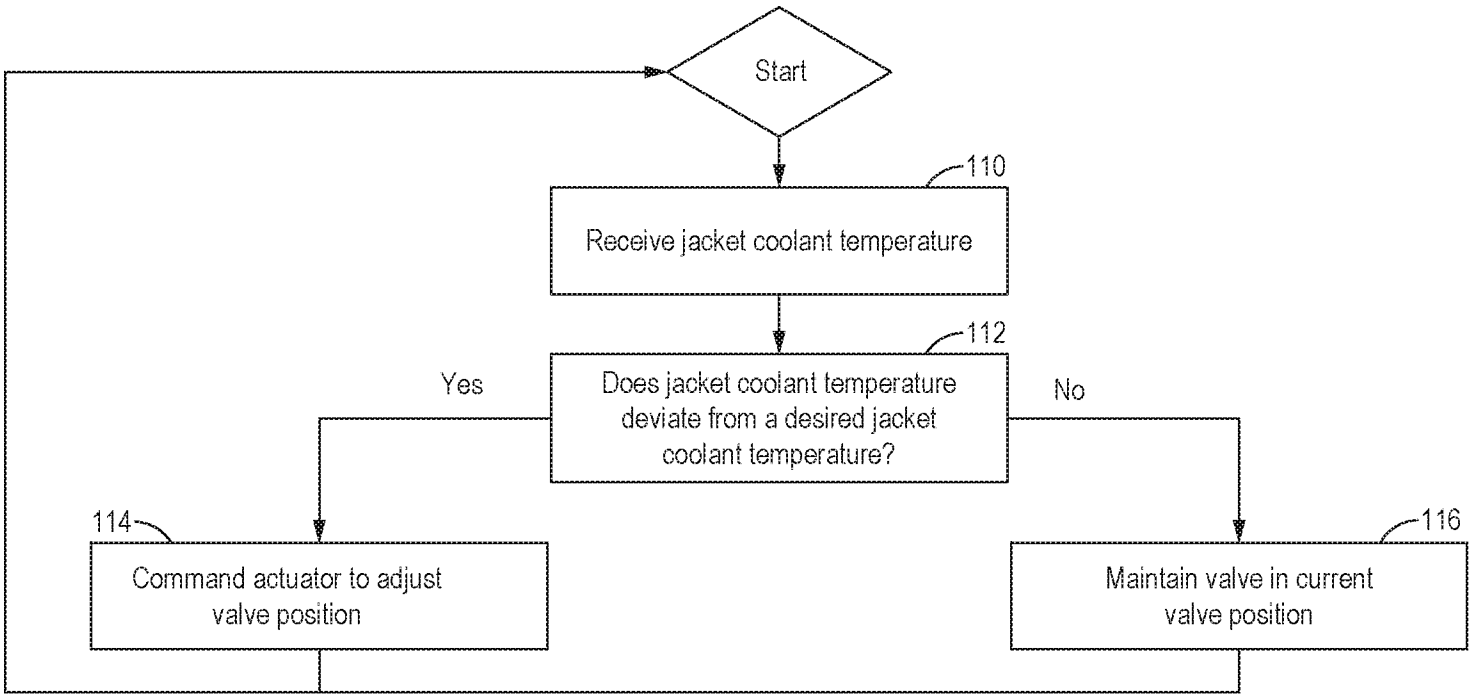
FIG. 8 is a flowchart of a series of steps that may be involved in regulating coolant flow through the jacket cooling system as implemented by the engine ECM, in accordance with another method of the present disclosure.

FIG. 8 shows another series of steps that may be involved in regulating the bypass valve 62 as implemented by the ECM 68 in accordance with the jacket cooling system 44 of FIG. 6. Specifically, FIG. 8 shows a method that may be involved in regulating the valve position of the bypass valve 70 according to the temperature feedback loop as described above in relation to FIG. 6. According to a first block 110, the PI controller 84 of the ECM 68 may receive signals indicative of the jacket coolant temperature from the temperature sensor 82. The PI controller 84 may then determine if the jacket coolant temperature deviates from the desired jacket coolant temperature (block 112) and, if so, may transmit a command to the actuator 72 to adjust the valve position of the bypass valve 70 to minimize or eliminate the temperature variation (block 114). Specifically, if the jacket coolant temperature is below the desired jacket coolant temperature (indicating less heat is being produced by the engine 16), the PI controller 84 may command the actuator 72 to open the bypass valve 70 to direct more coolant flow through the bypass circuit 58 and prevent heat loss from the engine. If the jacket coolant temperature is above the desired jacket coolant temperature (indicating more heat is being produced by the engine 16), the PI controller 84 may command the actuator 72 to close the bypass valve 70 so that more coolant flow is directed to the engine 16/coolant jacket 46 for heat absorption. As explained above, the PI controller 84 may command the actuator 72 to open or close the bypass valve 70 by a magnitude that is proportional to the temperature deviation between the jacket coolant temperature and the desired jacket coolant temperature. If, however, the jacket coolant temperature does not deviate from the desired jacket coolant temperature (indicating an appropriate amount of coolant flow to the engine 16/coolant jacket 46), then the current valve position may be maintained (block 116). The method of FIG. 8 may be repeated continually during the operation of the locomotive 12 to appropriately apportion coolant to the engine 16/coolant jacket 46 and to the bypass circuit 58 as the operation conditions vary.

The locomotive engine jacket cooling system disclosed herein provides a bypass circuit that allows coolant (e.g., water) to be diverted away from the engine coolant jacket under certain operating conditions, such as idle or lower power operating conditions or colder operating conditions (e.g., engine warm up). In current medium speed locomotives, the speed of the jacket coolant pump and the flow rate of coolant to the engine does not decrease in proportion to the drop in power on transitioning from rated power operating conditions to idle power operating conditions. As such, excess heat may be dissipated from the engine into the coolant under idle or lower power operating conditions, wasting heat energy that could otherwise be harnessed to perform useful work. Accordingly, fuel economy and engine emissions may be negatively impacted under idle or lower power operating conditions. The bypass circuit disclosed herein opens the bypass valve under idle or lower power operating conditions to prevent excess heat loss from the engine and thereby improve fuel economy and emissions.

The electronically-controlled bypass valve may be infinitely variable to allow fine tuning of the distribution of coolant flow to the engine coolant jacket and the bypass circuit according to engine operating conditions. Furthermore, coolant flow to the engine coolant jacket may be increased or decreased to achieve desired jacket water temperatures. The system disclosed herein also allows coolant to be diverted in the bypass direction under certain conditions, such as to speed up engine warm up time. Additionally, jacket coolant flow rates to the engine coolant jacket may be controlled electronically by the ECM, independently of the crankshaft rotation rate, using a valve control map relating operation conditions to desired bypass valve positions, or by a temperature feedback loop.

What is claimed is:

1. A jacket cooling system for an engine of a locomotive, comprising:

a jacket coolant pump driven by a crankshaft of the engine, the jacket coolant pump having an inlet and an outlet;

a coolant jacket associated with one or more cylinders of the engine, each cylinder having cylinder walls defining a combustion chamber;

a delivery conduit in fluid communication with the outlet and configured to deliver a coolant from the jacket coolant pump to the coolant jacket, the coolant jacket configured such that the coolant jacket circulates the coolant around the cylinder walls of each cylinder;

a bypass circuit configured to divert a portion of the coolant away from the delivery conduit and the engine, the bypass circuit routing the diverted portion of the coolant to the inlet of the jacket coolant pump, the bypass circuit having a bypass inlet connected to, and in fluid connection with, the delivery conduit; and an electronically-controlled bypass valve in the bypass circuit, the bypass valve allowing at least some of the coolant to flow through the bypass circuit when a valve position of the bypass valve is at least partially open, the bypass valve positioned downstream from the bypass inlet, wherein the bypass circuit and the bypass valve permit the jacket cooling system to increase a flow rate of coolant to the engine under rated power operating conditions, and to decrease the flow rate of coolant to the engine under idle or lower power operating conditions, and wherein when a temperature deviation exists between a jacket coolant temperature and a desired jacket coolant temperature, the flow rate of coolant is adjusted by a magnitude proportional to the temperature deviation until the temperature deviation is eliminated.

2. The jacket cooling system of claim 1, further comprising an electronic control module (ECM) associated with the engine and configured to electronically control the valve position of the bypass valve.

3. The jacket cooling system of claim 2, wherein the ECM is in communication with one or more operation condition sensors configured to monitor one or more operation conditions of the locomotive, and wherein the ECM is configured to control the valve position of the bypass valve based on signals received from the one or more operation condition sensors indicating the one or more operation conditions.

4. The jacket cooling system of claim 3, wherein the ECM is further configured to:

determine a desired valve position of the bypass valve from the one or more operation conditions using one or more valve control maps that relate the operation conditions to desired valve positions; and command an adjustment of the valve position to the desired valve position.

5. The jacket cooling system of claim 4, wherein the one or more operation conditions include one or more of engine speed, engine load, traveling altitude, ambient temperature, and special operating conditions.

6. The jacket cooling system of claim 5, wherein the ECM is further configured to:

command an opening of the bypass valve at engine speeds associated with idle or lower power operating conditions, and command a closing of the bypass valve at engine speeds associated with rated power operating conditions.

7. The jacket cooling system of claim 2, wherein the ECM is in communication with a temperature sensor configured to monitor the jacket coolant temperature of the coolant exiting the coolant jacket, and wherein the ECM is configured to control the valve position according to the jacket coolant temperature.

8. The jacket cooling system of claim 7, wherein the ECM is further configured to:

determine the temperature deviation between the jacket coolant temperature and the desired jacket coolant temperature; and to command an adjustment of the valve position that is proportional to the temperature deviation.

9. The jacket cooling system of claim 8, wherein the ECM is further configured to:

command an opening of the bypass valve when the jacket coolant temperature is below the desired jacket coolant temperature; and command a closing of the bypass valve when the jacket coolant temperature is above the desired jacket coolant temperature.

10. A locomotive, comprising:

an internal combustion engine including a cylinder having cylinder walls defining a combustion chamber;

a crankshaft driven for rotation by the internal combustion engine;

a coolant jacket associated with the cylinder;

a jacket coolant pump driven by the crankshaft and having an inlet and an outlet;

a delivery conduit in fluid communication with the outlet of the jacket coolant pump and configured to carry coolant from the jacket coolant pump to the coolant jacket, the coolant jacket configured such that the coolant jacket circulates the coolant around the cylinder walls of the cylinder;

a bypass circuit configured to divert a portion of the coolant away from the delivery conduit and the engine, the bypass circuit routing the diverted portion of the coolant to the inlet of the jacket coolant pump, the bypass circuit having a bypass inlet connected to, and in fluid connection with, the delivery conduit;

an electronic control module (ECM) associated with the engine the ECM configured to determine a temperature deviation between a jacket coolant temperature and a desired jacket coolant temperature;

a bypass valve in the bypass circuit and controlled by the ECM, the bypass valve positioned downstream from the bypass inlet, the bypass valve being configured to allow at least some of the coolant to flow through the bypass circuit when a valve position of the bypass valve is at least partially open, wherein the bypass circuit and the bypass valve permit the jacket cooling system to increase a flow rate of coolant to the engine under rated power operating conditions, and to decrease the flow rate of coolant to the engine under idle or lower power operating conditions; and an actuator associated with the bypass valve and in electronic communication with the ECM, the actuator being configured to actuate shifting of the valve position of the bypass valve according to commands from the ECM, the ECM configured to command to the actuator to open or close the bypass valve until the temperature deviation is eliminated.

11. The locomotive of claim 10, wherein the internal combustion engine is a medium speed diesel engine.

12. The locomotive of claim 10, wherein the actuator is one of an electronic actuator, a hydraulic actuator, and a pneumatic actuator.

13. The locomotive of claim 10, wherein the ECM is in communication with one or more operation condition sensors configured to monitor one or more operation conditions of the locomotive, and wherein the ECM is configured to control the valve position of the bypass valve based on signals received from the one or more operation condition sensors indicating the one or more operation conditions.

14. The locomotive of claim 13, wherein the one or more operation conditions include one or more of engine speed, engine load, traveling altitude, ambient temperature, and special operating conditions.

15. The locomotive of claim 14, wherein the ECM is further configured to:

determine a desired valve position of the bypass valve from the one or more operation conditions using one or more valve control maps that relate the operation conditions to desired valve positions; and transmit a command to the actuator to adjust the valve position to the desired valve position.

16. The locomotive of claim 10, wherein the ECM is in communication with a temperature sensor configured to monitor the jacket coolant temperature of the coolant exiting the coolant jacket, and wherein the ECM is configured to control the valve position according to the jacket coolant temperature.

17. The locomotive of claim 16, wherein the ECM is further configured to:

transmit a command to the actuator to open or close the bypass valve by a magnitude that is proportional to the temperature deviation.

18. The locomotive of claim 17, wherein the ECM is further configured to:

transmit a command to the actuator to open the bypass valve when the jacket coolant temperature is below the desired jacket coolant temperature; and transmit a command to the actuator to close the bypass valve when the jacket coolant temperature is above the desired jacket coolant temperature.

19. A method for regulating a flow of coolant through a jacket cooling system associated with an engine of a locomotive, the jacket cooling system including a jacket coolant pump, a delivery conduit configured to deliver the coolant from the jacket coolant pump to a coolant jacket associated with the engine, and a bypass valve allowing at least some of the coolant to be diverted away from the delivery conduit and into a bypass circuit when at least partially open, the bypass circuit having a bypass inlet connected to the delivery conduit, the bypass valve being positioned downstream from the bypass inlet, the coolant jacket configured to circulate the coolant around cylinder walls associated with one or more cylinders in the engine, the method comprising:

receiving one or more signals indicating one or more operation conditions of the locomotive, the one or more signals including a jacket coolant temperature;

determining a desired valve position based on the one or more signals indicating the one or more operation conditions of the locomotive;

determining a temperature deviation between the jacket coolant temperature and a desired jacket coolant temperature;

determining if the desired valve position deviates from a current valve position of the bypass valve, wherein the bypass circuit and the bypass valve permit the jacket cooling system to increase a flow rate of coolant to the engine under rated power operating conditions, and to decrease the flow rate of coolant to the engine under idle or lower power operating conditions;

commanding an actuator associated with the bypass valve to adjust the current valve position to the desired valve position if the current valve position deviates from the desired valve position; and commanding the actuator associated with the bypass valve to open or close the bypass valve by a magnitude proportional to the temperature deviation until the temperature deviation is eliminated.

20. The method of claim 19, wherein determining the desired valve position comprises determining the desired valve position from one or more valve control maps that relate the one or more operation conditions to desired valve positions.

* * * * *